US006054096A

United States Patent [19]

Duhl et al.

[11] Patent Number: 6,054,096

[45] Date of Patent: Apr. 25, 2000

[54] STABLE HEAT TREATABLE NICKEL SUPERALLOY SINGLE CRYSTAL ARTICLES AND COMPOSITIONS

[75] Inventors: David N. Duhl, Newington; Alan D. Cetel, West Hartford, both of Conn.

[73] Assignee: United Technologies Corporation, Hartford, Conn.

[21] Appl. No.: 08/962,899

[22] Filed: Nov. 3, 1997

Related U.S. Application Data

[60] Continuation of application No. 07/147,463, Jan. 25, 1988, abandoned, which is a division of application No. 06/788,893, Aug. 14, 1985, abandoned, which is a division of application No. 06/453,202, Dec. 27, 1982, abandoned.

[51] Int. Cl.[7] ..... C22C 19/05

[52] U.S. Cl. ..... 420/448; 420/442; 420/445; 420/446; 420/447

[58] Field of Search ..... 420/445, 448, 420/446, 447; 148/404, 410, 428

[56] References Cited

U.S. PATENT DOCUMENTS

| | | | |
|---|---|---|---|
| 3,494,709 | 2/1970 | Piearcey | 148/404 |
| 4,209,348 | 6/1980 | Duhl et al. | 148/555 |

*Primary Examiner*—Daniel J. Jenkins
*Attorney, Agent, or Firm*—Charles E. Sohl

[57] ABSTRACT

Improved compositions for fabricating nickel superalloy single crystal articles are described. The compositions are characterized by the substantial absence of carbon, boron, zirconium and vanadium and intentional additions of cobalt. The cobalt additions increase the stability of the compositions and provide enhanced heat treatability. Single crystal articles of these compositions have utility as gas turbine engine components.

13 Claims, 2 Drawing Sheets

STABLE HEAT TREATABLE NICKEL SUPERALLOY SINGLE CRYSTAL ARTICLES AND COMPOSITIONS

This application is a continuation of application Ser. No. 07/147,463 filed Jan. 25, 1988, now abandoned, which is a divisional of application Ser. No. 06/788,893, filed Aug. 8,1985, now abandoned, which is a divisional of application Ser. No. 06/453,202, filed Dec. 27, 1982, now abandoned.

TECHNICAL FIELD

This invention relates to compositions which have utility as single crystal gas turbine engine components.

BACKGROUND ART

Single crystal gas turbine engine components offer the promise of improved performance in gas turbine engines. U.S. Pat. No. 3,494,709 which is assigned to the assignee of the present invention, discloses the use of single crystal components in gas turbine engines. This patent discusses the desirability of limiting certain elements such as boron and zirconium to low levels. The limitation of carbon to low levels in single crystal superalloy articles is discussed in U.S. Pat. No. 3,567,526. U.S. Pat. No. 4,116,723 describes heat treated superalloy single crystal articles which are free from intentional additions of cobalt, boron, zirconium and hafnium. According to this patent, elimination of these elements render the compositions heat treatable.

DISCLOSURE OF INVENTION

An improved composition range is described for the production of heat treatable nickel superalloy single crystal articles. The broad composition contains 5%–12% chromium, 2%–8% aluminum, 0%–6% titanium, 0%–9.5% tantalum, 0%–12% tungsten, 0%–3% molybdenum; 0%–3% columbium; 0%–3.5% hafnium; 0%–7% rhenium; and balance essentially nickel. The preferred composition contains 7%–12% chromium; 3%–7% aluminum; 1%–5% titanium; 1%–8% tantalum; 0%–12% tungsten; 0%–0.8% molybdenum; 0%–3% columbium; 0%–2.5% hafnium; 0%–7% rhenium; and balance essentially nickel. The composition is free from intentional additions of carbon, boron, zirconium and vanadium. The composition contains an intentional addition of cobalt sufficient to render it stable and immune to the formation of deleterious phases. The composition with the addition of cobalt also has enhanced heat treatability; the temperature range between the gamma prime solves temperature and incipient melting temperature is increased over that which would be possessed by a cobalt-free alloy.

The foregoing, and other features and advantages of the present invention, will become more apparent from the following description and accompanying drawing.

BEST MODE FOR CARRYING OUT THE INVENTION

Figure 1:
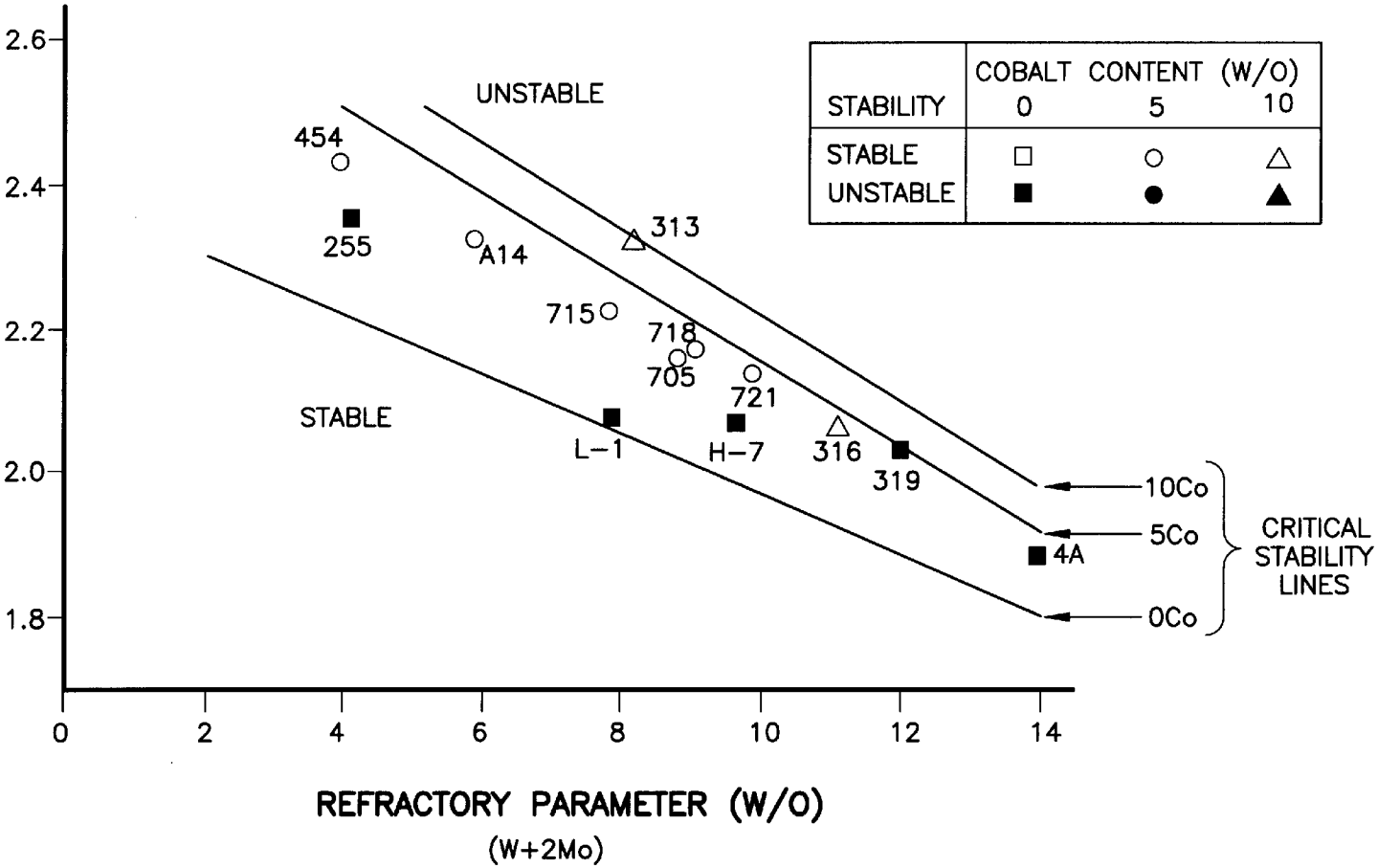
FIG. 1 shows the effect of cobalt on the micro-structural stability of rhenium-free nickel base super-alloy compositions.

The present invention is concerned with nickel base single crystal articles which find application in aircraft gas turbine engines. More specifically, the invention relates to nickel base single crystal articles containing from about 5% to about 12% chromium, from about 2% to about 8% aluminum, up to about 6% titanium, with the sum of the aluminum and titanium exceeding about 4%, up to about 9.5% tantalum, up to about 12% tungsten, up to about 3% molybdenum, up to about 3% columbium, up to about 3.5% hafnium, up to about 7% rhenium, with the sum of the molybdenum, columbium, hafnium, rhenium, tantalum and tungsten contents exceeding 5%, with the composition being free from intentional additions of carbon, boron, zirconium and vanadium, and with the composition containing an intentional addition of cobalt sufficient to render it stable (unless otherwise indicated, all percentage values are in weight percents). Preferably, the composition contains 5%–12% chromium, 3%–7% aluminum, 1%–5% titanium, 1%–8% tantalum, 0%–12% tungsten, 0%–0.8% molybdenum, 0%–3% columbium, 0%–2.5% hafnium, 0%–7% rhenium, balance essentially nickel. Preferably, the sum of the aluminum and titanium contents exceeds about 5% and the sum of the molybdenum, columbium, hafnium, rhenium, tantalum and tungsten exceeds about 10%. Further, the ratio of the titanium to aluminum is preferably less than about 1:1.

Chromium and aluminum contents in the amounts presented above ensure that the alloy forms a protective alumina layer upon exposure to elevated temperatures. This type of oxidation behavior is necessary for long component life. With less than about 5% chromium, the required aluminum layer will not form reliably while chromium contents in excess of about 12% tend to reduce the overall strength of the alloy. The aluminum and titanium act together to form the gamma prime strengthening phase ($Ni_3(Al, Ti)$). The required alloy strength will be obtained when the sum of the aluminum and titanium exceeds 4%, and preferably about 5%. The ratio of the titanium to aluminum is controlled, preferably to be less than about 1:1; again, this helps to ensure that the desired alumina oxide protective layer is formed. The elements tantalum, tungsten, molybdenum, columbium, hafnium and rhenium are referred to as refractory elements and are present in the alloy for the purpose of strengthening. The elements tungsten, molybdenum and rhenium partition mainly to the gamma matrix phase while the elements tantalum and columbium partition to the gamma prime strengthening phase. A mixture of refractory elements is desirable for satisfactory alloy performance and the sum of these elements should exceed 5% and preferably 10%. Those alloys which contain the lesser amounts of these strengthening elements will generally be useful in vane or other nonrotating applications while those compositions containing the higher amounts of these strengthening elements will find application in blades and other similar more highly stressed engine components.

These compositions find application in single crystal components which are cast components free from internal grain boundaries. In conventional superalloys, the elements of carbon, boron, zirconium are added for the primary purpose of strengthening the grain boundaries while in single crystal components which contain no such grain boundaries; substantial benefits are obtained by the substantial exclusion of these elements. Exclusion of these elements also increases the incipient melting temperature, thereby making it easier to solution heat treat. This subject is discussed at some length in U.S. Pat. No. 4,116,723. Vanadium has been added to certain superalloys for the purpose of gamma prime formation and minimizes the gamma prime being present as a low melting eutectic, but causes a substantial detriment in the hot corrosion behavior of the alloys and consequently is excluded from the present composition.

The intentional addition of cobalt in closely controlled amounts is a significant part of the present invention. Nickel base superalloys are compositionally complex and are used in service under extreme conditions of temperature and stress. Certain superalloys have been observed to be microstructurally unstable under service conditions; the term instability relates to the formation of extraneous phases as a result of long term exposure to service conditions. These phases are often referred to as the topologically close-packed phases or TCP phases and include the phases, among others, referred to as sigma and mu. These phases are undesirable since they are generally brittle and of low strength, and their formation may deplete the alloy of the refractory elements that give it strength. Consequently, their formation in a highly stressed part in service can lead to premature catastrophic failure. Extensive prior art investigations have related the formation of these phases to the parameter referred to as $N_v$ or the electron vacancy number. A preferred method (usedin the prior art) for calculating the $N_v$ number for a superalloy matrix is given below:

1. Convert the composition from weight percent to atomic percent;
2. After long time exposure in the TCP phase forming temperature range, the MC carbides tend to transfrom to $M_{23}C_6$,
   a) assume one-half of the carbon forms MC in the following preferential order: TaC, NbC, TiC,
   b) assume the remaining carbon forms $M_{23}C_6$ of the following composition: $Cr_{21}(Mo, W, Re)_2\ C_6$ or $Cr_{23}C_6$ in the absence of molybdenum, tungsten or rhenium;
3. Assume boron forms M3B2 of the following composition: $(Mo_{0.5}Ti_{0.15}Cr_{0.25}N_{0.10})_3B_2$;
4. Assume gamma prime to be of the following composition: $Ni_3$ (Al, Ti, Ta, Nb, Zr, 0.5 V, 0.03 Cr*);
5. The residual matrix will consist of the atomic percent minus those atoms tied up in the carbide reaction, boride reaction, and the gamma prime reaction. The total of these remaining atomic percentages gives the atomic concentration in the matrix. Conversion of this on the 100% basis gives the atomic percent of each element remaining in the matrix. It is this percentage that is used in order to calculate the electron vacancy number; and
6. The formula for calculation of the electron vacancy number is as follows:

$$(\overline{N}_v\text{ref})=0.61\ Ni+1.71\ Co+2.66\ Fe+3.66\ Mn+4.66\ (Cr+Mo+W+Fe)+5.66\ V+6.66\ Si.$$

*(0.03% of the original atomic percent).

As a general rule in prior art compositions, sigma phase is anticipated when the $N_v$ value exceeds about 2.5. The present invention arises in part from the discovery that the relationship of $N_v$ to alloy instability is more complex than had previously been anticipated, and that judicious additions of cobalt substantially improves the stability of alloys even though the $N_v$ number is not substantially affected.

FIG. 1 shows the relationship between the electron vacancy number and a refractory parameter for several rhenium-free experimentally tested alloys. FIG. 1 also shows several lines which define the stable and unstable alloy regions for alloys containing various cobalt levels. From FIG. 1, it can be seen that for a particular value of the refractory parameter, additions of cobalt up to about 10% substantially increase the threshold electron vacancy number at which instability occurs. This observation is contrary to the prior art which had generally treated the $N_v$ number as being the sole parameter controlling alloy stability. Prior art indicated that additions of cobalt would increase the instability of the alloy.

As previously indicated, superalloys derive a substantial portion of their strength from the presence of solid solution strengtheners such as the refractory metals. However, those refractory metals including tungsten, molybdenum and rhenium which substantially partition to the matrix, also have the effect of increasing the electron vacancy number. Through the additions of cobalt as taught by the present invention in FIG. 1, high refractory element additions may be made for strength purposes while cobalt additions may also be made sufficient to render an unstable alloy, stable, even though they raise the electron vacancy number ($N_v$) which prior art suggests would cause a further decrease in stability.

The alloy compositions which are shown as points in FIG. 1 are given in Table I. Compare, for example, alloy L1 and alloy 705, alloys which have substantially the same refractory metal content. Alloy L1 is unstable, yet alloy 705 which contains 5% cobalt is stable. Thus, it is now possible through the use of judicious cobalt additions to render previously unstable alloys stable and suitable for long term use under severe conditions. From FIG. 1, it can be seen that the refractory content affects the $N_v$ level at which the alloy becomes unstable. For cobalt-free alloys, the equation for the line separating stable and unstable alloys is about $N_v=2.39-((W+2Mo)\times0.043)$. Alloys with $N_v$ levels in excess of this will be unstable. A significant aspect of this invention is the discovery that cobalt additions change the boundary between stable and unstable regions.

For example, alloys containing 5% cobalt are stable for $N_v<2.74-((W+2Mo)\times0.057)$ to a maximum of about 2.5 and alloys containing 10% cobalt are stable for $N_v<2.82-((W+2Mo)\times0.058)$ to a maximum of about 2.5. Thus, a feature of this invention is the discovery of stable single crystal alloy compositions in the regions where:

$2.39-((W+2Mo)\times0.043)<N_v<2.82-((W+2Mo)\times0.058)$ for alloys with 10% cobalt; and $2.39-((W+2Mo)\times0.043)<N_v<2.74-((W+2Mo)\times0.057)$ for alloys with 5% cobalt.

Figure 2:
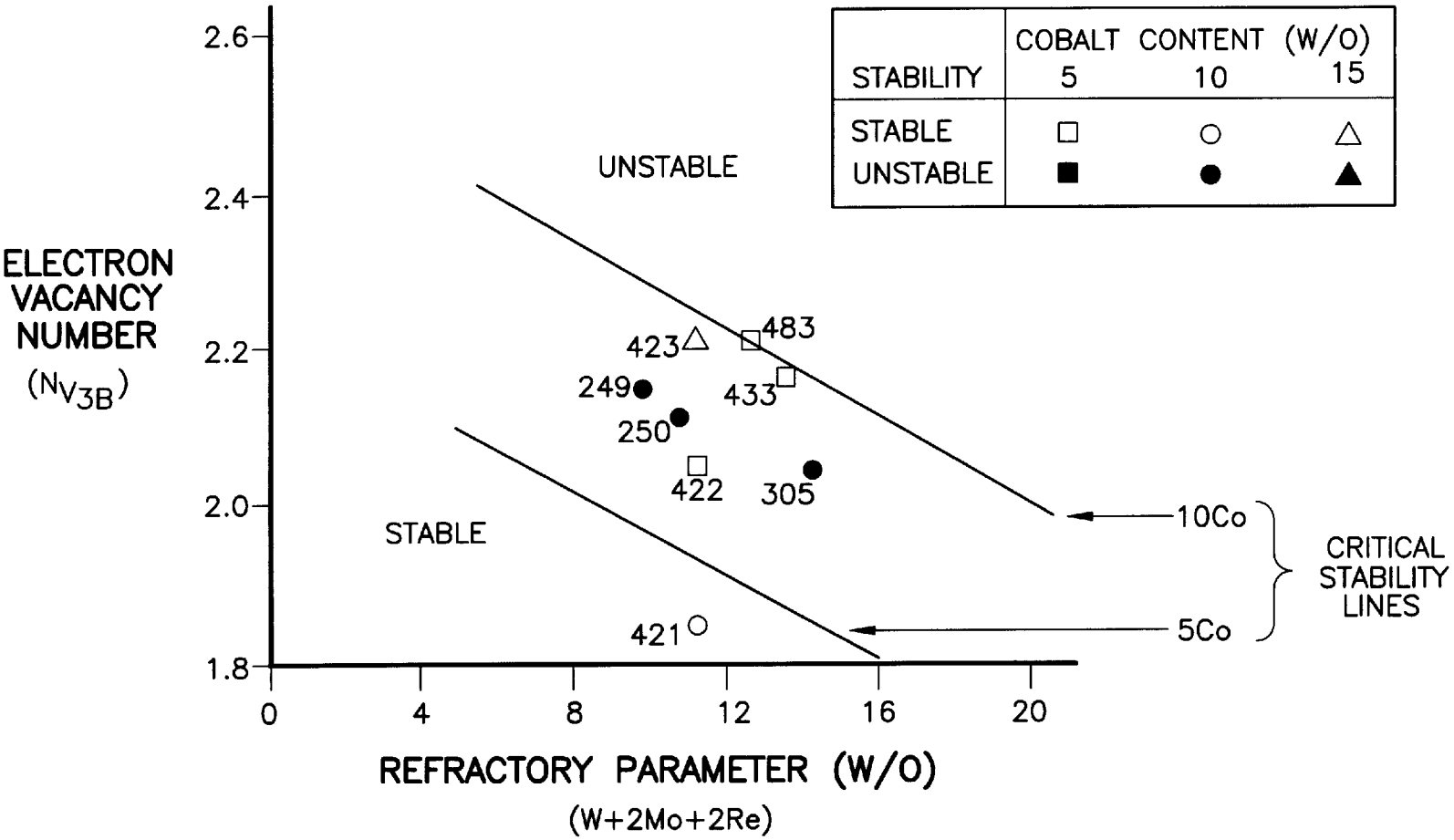
FIG. 2 shows the effect of cobalt on the micro-structural stability of rhenium containing nickel base superalloy compositions.

For rhenium-containing superalloys, cobalt also plays a significant role in determining alloy stability. As taught by the present invention, sufficient additions of cobalt may be made to an unstable alloy to to render the alloy stable. Prior art would indicate that raising the level of cobalt in an unstable alloy, thus increasing the electron vacancy number ($N_v$) would further decrease alloy stability. As shown in FIG. 2, increases in alloy stability are acquired through judicious additions of cobalt.

The alloy compositions which are shown as points in FIG. 2 are given in Table II. Compare, for example, alloy 250 and alloy 483, alloys which have substantially the same refractory element content. Alloy 250 is unstable, yet alloy 483 with 5% more cobalt than alloy 250 is stable enough, though its electron vacancy number is 0.1 higher than that of alloy 250. Thus, it is possible to control alloy stability and thus render unstable alloys suitable for long time service under severe conditions through judicious applications of cobalt.

From FIG. 2, it can be seen that the refractory content affects the $N_v$ level at which the alloy becomes unstable. For alloys containing 10% cobalt, the equation for the line separating stable and unstable alloys is (composition in weight percent) $N_v$=2.56–0.027 (W+2Mo+2Re) to a maximum of about 2.5.

Alloys with $N_V$ levels in excess of this will be unstable. As previously shown in FIG. 1, with rhenium-free alloys, cobalt additions to rhenium containing alloys change the boundary between stable and unstable regions.

For example, alloys containing 5% cobalt are stable for $N_v$ <2.23–0.027 (W+2Mo+2Re). Thus, a feature of this invention is the discovery of stable rhenium containing single crystal alloys in the region of 2.23–0.027 (W+2Mo+2Re) <$N_v$<2.56–0.027 (W+2Mo+2Re) for alloys with 10% cobalt (and for $N_v$ up to about 2.5).

The surprising and unexpected effect of cobalt on alloy stability stands as a notable contribution to the art permitting the development of stable alloys with higher strength properties than those previously known. However, the effect of cobalt is also substantial in another area. It is now generally appreciated that maximum superalloy properties are obtained when the alloys are properly heat treated. Heat treatment of superalloys involves heating to a temperature above the gamma prime solves temperature in order to dissolve the coarse, as-cast gamma prime structure followed by rapid cooling and reheating to a lower temperature for controlled reprecipitation of the gamma prime phase on a fine scale. Many of the complex modern superalloys have a small temperature difference between the required temperature for solution heat treatment and the incipient melting temperature. This makes heat treatment difficult, especially on a production scale where minor compositional variations between metal heats cause variations in the gamma prime and incipient melting temperatures. As will be shown below, the additions of small amounts of cobalt serve to increase the heat treatment range and makes possible the heat treatment of high strength alloys which had heretofore not been heat treatable in the absence of cobalt and thus, makes possible the achievement of the maximum strength capabilities of these alloys.

Each of the pairs of alloys set forth in Table III differs significantly only in the addition of 5% or 10% cobalt, yet in each of these cases, the cobalt addition makes a substantial change in the solution heat treatment range. The change ranges from 10° F. to 35° F. (6° C. to 19° C.) and in two cases, makes possible the heat treatment of alloys which could previously not be heat treated without incipient melting. Some indication as to the significance of this improved heat treatment capability is shown in Table IV. It should be noted that the alloys 255 and 454 are outside of the scope of the present invention by virtue of their high tantalum content. Nonetheless, a comparison of their properties is instructive. Alloy 255 differs from alloy 454 in that it lacks the cobalt content of alloy 454. The incipient melting temperature and gamma prime solves of alloy 255 are both about 2380° F. (1304.4° C.). Heat treatment at 2380° F. (1304.4° C.) of alloy 255 results in substantial incipient melting. The rupture life of alloy 255 at 1800° F./36 ksi (982° C./25.3 kg/mm$^2$) after heat treatment at 2380° F. (1304.4° C.) is about 40 hours, and the time to 1% creep is about 15 hours. Decreasing the heat treatment temperature of alloy 255 to 2370° F. (1299° C.) effectively eliminates incipient melting, but produces only partial heat treatment since not all of the coarse, as-cast, gamma prime phase is dissolved into the gamma solid solution. However, the effect of even this partial solution treatment in the absence of incipient melting is to raise the rupture life to about 53 hours and the time to 1% creep to about 16 hours. Alloy 454 can be fully solution heat treated at 2350° F. (1288° C.) without incipient melting and after the full solution heat treatment, the rupture life is 90 hours and the time to 1% creep is 30 hours. This illustrates the importance of full solution heat treatment and the importance of avoiding incipient melting if maximum properties are to be achieved.

Although this invention has been shown and described with respect to detailed embodiments thereof, it will be understood by those skilled in the art that various changes in form and detail thereof may be made without departing from the spirit and scope of the claimed invention.

TABLE I

Effect of Cobalt on Microstructural Stability of Single Crystal Nickel-Base Superalloys

| | | Microstructural | Composition (Weight Percent) | | | | | | | | |
|---|---|---|---|---|---|---|---|---|---|---|---|
| Alloy | $N_{V_{3B}}$ | Stability | Co | Cr | Ti | Mo | W | Ta | Al | Hf | V |
| 319 | 2.03 | Unstable | 0 | 8.2 | .99 | 1.0 | 10.0 | 6.6 | 5.1 | .1 | 0 |
| L-1 | 2.08 | Unstable | 0 | 8.9 | .98 | 0 | 7.9 | 6.0 | 5.9 | .1 | 0 |
| H-7 | 2.07 | Unstable | 0 | 9.9 | 1.42 | 1.4 | 6.9 | 5.9 | 5.0 | .1 | 0 |
| 4A | 1.89 | Unstable | 0 | 7.9 | .97 | 2.1 | 9.9 | 3.0 | 5.4 | .1 | 0 |
| 255 | 2.35 | Unstable | 0 | 9.8 | 1.38 | 0 | 4.1 | 11.9 | 5.2 | 0 | 0 |
| 454 | 2.43 | Stable | 4.9 | 9.6 | 1.6 | 0 | 4.0 | 12.0 | 4.9 | 0 | 0 |

TABLE I-continued

Effect of Cobalt on Microstructural Stability of Single Crystal Nickel-Base Superalloys

| Alloy | $N_{V_{3B}}$ | Microstructural Stability | Composition (Weight Percent) Co | Cr | Ti | Mo | W | Ta | Al | Hf | V |
|---|---|---|---|---|---|---|---|---|---|---|---|
| 705 | 2.16 | Stable | 5.1 | 8.9 | .92 | 1.05 | 6.8 | 6.0 | 5.6 | .1 | 0 |
| 715 | 2.21 | Stable | 5.1 | 10.0 | .99 | 0 | 7.9 | 5.0 | 5.6 | .1 | 0 |
| 718 | 2.18 | Stable | 5.1 | 10.0 | .38 | 0 | 8.9 | 6.0 | 5.1 | .1 | 0 |
| 721 | 2.14 | Stable | 5.0 | 9.0 | .99 | 0 | 9.9 | 6.1 | 5.1 | .1 | 0 |
| A14 | 2.32 | Stable | 5.0 | 11.8 | 0 | 0 | 5.9 | 10.5 | 4.9 | 0 | 0 |
| 313 | 2.34 | Stable | 10.2 | 7.6 | .93 | 2.02 | 4.1 | 10.4 | 5.0 | .1 | .5 |
| 316 | 2.06 | Stable | 10.0 | 5.2 | 1.52 | 2.04 | 7.0 | 5.1 | 5.6 | .1 | .4 |

TABLE II

Effect of Cobalt on Microstructural Stability of Rhenium Containing Nickel-Base Superalloys

| Alloy | $N_{V_{3B}}$ | Microstructural Stability | Composition (Weight Percent) Re | Co | Cr | Ti | Mo | W | Ta | Al | Hf | V |
|---|---|---|---|---|---|---|---|---|---|---|---|---|
| 483 | 2.22 | Stable | 2.8 | 10.0 | 7.5 | 0 | 2.0 | 3.0 | 10.2 | 5.3 | .1 | 0 |
| 433 | 2.17 | Stable | 3.0 | 10.0 | 4.9 | 0 | 2.3 | 3.0 | 11.9 | 5.2 | 0 | .7 |
| 249 | 2.15 | Unstable | 1.9 | 4.8 | 7.6 | 0 | 1.9 | 2.2 | 12.0 | 5.0 | 0 | .8 |
| 250 | 2.12 | Unstable | 2.9 | 4.7 | 7.6 | 0 | 1.9 | 1.2 | 11.9 | 5.0 | 0 | .7 |
| 305 | 2.05 | Unstable | 3.0 | 4.9 | 4.8 | .9 | 2.1 | 4.0 | 12.2 | 5.0 | 0 | 0 |
| 421 | 1.85 | Stable | 3.0 | 5.1 | 5.0 | 0 | 2.1 | 1.1 | 11.7 | 5.2 | 0 | .7 |
| 422 | 2.06 | Stable | 3.0 | 10.0 | 4.9 | 0 | 2.1 | 1.0 | 11.7 | 5.4 | 0 | .7 |
| 423 | 2.22 | Stable | 2.9 | 15.0 | 4.9 | 0 | 2.1 | 1.0 | 12.0 | 5.3 | 0 | .7 |

TABLE III

Effect of Cobalt on Heat Treatment Response of Single Crystal Nickel-Base Superalloys

| Alloy | Gamma Prime Solvus (° F.) | Incipient Melting Temperature (° F.) | Solution Heat Treatment Range (° F.) | Composition (Weight Percent) Cr | Ti | Mo | W | Ta | Al | Co | Re | Hf |
|---|---|---|---|---|---|---|---|---|---|---|---|---|
| 255 | 2400 | 2380 | −20 | 9.8 | 1.38 | 0 | 4.1 | 11.9 | 5.2 | 0 | 0 | 0 |
| 454 | 2350 | 2365 | 15 | 10 | 1.5 | 0 | 4 | 12 | 5 | 5 | 0 | 0 |
| 706 | 2355 | 2410 | 55 | 9.0 | .96 | 1.05 | 7.0 | 5.8 | 5.5 | 0 | 0 | .1 |
| 705 | 2330 | 2405 | 75 | 8.9 | .92 | 1.05 | 6.8 | 6.0 | 5.6 | 5.1 | 0 | .1 |
| 301 | 2385 | 2390 | 5 | 7.5 | .96 | 1.64 | 3.7 | 11.8 | 5.0 | 4.9 | 0 | 0 |
| 302 | 2355 | 2375 | 20 | 7.6 | 1.01 | 1.87 | 3.8 | 11.8 | 5.1 | 9.9 | 0 | 0 |
| 305 | 2425 | 2415 | −10 | 4.8 | .94 | 2.1 | 4.0 | 12.2 | 5.0 | 4.9 | 3.0 | 0 |
| 306 | 2395 | 2395 | 0 | 4.9 | .94 | 2.1 | 4.2 | 11.8 | 5.0 | 9.9 | 3.0 | 0 |

TABLE IV

1800° F./36 ksi

| Alloy | Heat Treatment | Life | 1% |
|---|---|---|---|
| 255 | 2380° F. (Melting) | 40.5 hrs | 18.1 hrs |
| (10 Cr, 1.5 Ti, | | 44.0 | 13.4 |
| 5 Al, 4 W, | | 38.8 | 12.9 |
| 12 Ta, Bal. Ni) | | | |
| | 2370° F. (Partial | 51.4 | 16.0 |
| | Solutioning) | 55.0 | 17.0 |
| 454 | 2350° F. (Fully | 90 | 30 |
| (10 Cr, 5 Co, | Solutioned) | | |

TABLE IV-continued

1800° F./36 ksi

| Alloy | Heat Treatment | Life | 1% |
|---|---|---|---|
| 1.5 Ti, 5 Al, | | | |
| 4 W, 12 ta, | | | |
| Bal. Ni) | | | |

We claim:

1. A composition useful in the production of single crystal turbine articles consisting of:

a. from about 5% to about 12% chromium;

b. from about 2% to about 8% aluminum;

c. up to about 6% titanium, with the sum of the aluminum and titanium contents being at least 4% and the ratio of aluminum to titanium being at least 1:1;

d. up to about 9.5% tantalum;

e. up to about 12% tungsten;

f. up to about 3% molybdenum;

g. up to about 3% columbium;

h. up to about 3.5% hafnium;

i. up to about 7% rhenium;

j. with the sum of molybdenum, columbium, hafnium, rhenium, tantalum and tungsten exceeding 5%;

k. said composition being free from intentional additions of carbon, boron, zirconium and vanadium;

l. an intentional addition of cobalt sufficient to render the composition stable according to the criteria set out in FIGS. 1 or 2, wherein the addition of cobalt is from 1–10%; balance essentially nickel.

2. A composition as in claim 1 containing 7%–12% chromium, 3%–7% aluminum, 1%–5% titanium, 1%–8% tantalum, and up to 2.5% hafnium.

3. A composition as in claim 1 in which the sum of the Ta+W+Mo+Cb+Hf+Re exceeds about 10%.

4. A single crystal article having a good combination of properties at elevated temperature which comprises:

a. from about 7% to about 12% chromium;

b. from about 2% to about 8% aluminum;

c. up to about 6% titanium, with the sum of the aluminum and titanium contents being at least 4% and the ratio of aluminum to titanium being at least 1:1;

d. from about 1.0% to about 9.5% tantalum;

e. from about 2% to about 12% tungsten;

f. up to about 3% molybdenum;

g. up to about 3% columbium;

h. up to about 3.5% hafnium;

i. up to about 7% rhenium;

j. with the sum of molybdenum, columbium, hafnium, rhenium, tantalum and tungsten exceeding 5%;

k. said composition being free from intentional additions of carbon, boron, zirconium and vanadium;

l. an intentional addition of cobalt sufficient to render the composition stable according to the criteria set out in FIGS. 1 or 2, wherein the addition of cobalt is from 1–10%; balance essentially nickel, said article being free from internal grain boundaries, said article being heat treatable as a result of having an incipient melting temperature which is higher than the gamma prime solves temperature.

5. A heat treated single crystal gas turbine component having good properties at elevated temperature which comprises:

a. from about 7% to about 12% chromium;

b. from about 2% to about 8% aluminum;

c. up to about 6% titanium, with the sum of the aluminum and titanium contents being at least 4% and the ratio of aluminum to titanium being at least 1:1;

d. from about 1.0% to about 9.5% tantalum;

e. from about 2% to about 12% tungsten;

f. up to about 3% molybdenum;

g. up to about 3% columbium;

h. up to about 3.5% hafnium;

i. up to about 7% rhenium;

j. with the sum of molybdenum, columbium, hafnium, rhenium, tantalum and tungsten exceeding 5%;

k. said composition being free from intentional additions of carbon, boron, zirconium and vanadium;

l. an intentional addition of cobalt sufficient to render the composition stable according to the criteria set out in FIGS. 1 or 2, wherein the addition of cobalt is from 1–19%; balance essentially nickel, said component having a uniform fine distribution of the gamma prime phase, with an average gamma prime particle dimension of less than about 0.4 micron.

6. A method of rendering an otherwise phase unstable rhenium-free nickel base superalloy phase stable which comprises adding from 1–10% cobalt in accordance with FIG. 1.

7. A method of rendering an otherwise phase unstable rhenium containing nickel base superalloy phase stable which comprises adding from 1–10% cobalt in accordance with FIG. 2.

8. A method of rendering an otherwise phase unstable rhenium-free nickel base superalloy phase stable, said alloy consisting essentially of:

a. from about 7% to about 12% chromium;

b. from about 2% to about 8% aluminum;

c. up to about 6% titanium, with the sum of the aluminum and titanium contents being at least 4% and the ratio of aluminum to titanium being at least 1:1;

d. from about 1.0% to about 9.5% tantalum;

e. from about 2% to about 12% tungsten;

f. up to about 0.8% molybdenum;

g. up to about 3% columbium;

h. up to about 3.5% hafnium;

i. with the sum of molybdenum, columbium, hafnium, tantalum and tungsten exceeding 5%;

j. said composition being free from intentional additions of carbon, boron, zirconium and vanadium; balance essentially nickel, which comprises:

adding from 1–10% cobalt in accordance with FIG. 1 whereby the alloy will be rendered phase stable.

9. A method of rendering an otherwise phase unstable rhenium containing nickel base superalloy phase stable, said alloy consisting essentially of:

a. from about 7% to about 12% chromium;

b. from about 2% to about 8% aluminum;

c. up to about 6% titanium, with the sum of the aluminum and titanium contents being at least 4% and the ratio of aluminum to titanium being at least 1:1;

d. from about 1.0% to about 9.5% tantalum;

e. from about 2% to about 12% tungsten;

f. up to about 0.8% molybdenum;

g. up to about 3% columbium;

h. up to about 3.5% hafnium;

i. an intentional addition of rhenium of up to 7%;

j. with the sum of molybdenum, columbium, hafnium, rhenium, tantalum and tungsten exceeding 5%;

k. said composition being free from intentional additions of carbon, boron, zirconium and vanadium; balance essentially nickel, which comprises:

adding from 1–10% cobalt in accordance with FIG. 2 whereby the alloy will be rendered phase stable.

10. A method of rendering an otherwise phase unstable rhenium-free nickel base superalloy phase stable, said alloy consisting essentially of:

a. from about 7% to about 12% chromium;

b. from about 2% to about 8% aluminum;

c. up to about 6% titanium, with the sum of the aluminum and titanium contents being at least 4% and the ratio of aluminum to titanium being at least 1:1;

d. from about 1.0% to about 9.5% tantalum;

e. from about 2% to about 12% tungsten;

f. up to about 3% molybdenum;

g. up to about 3% columbium;

h. up to about 3.5% hafnium;

i. with the sum of molybdenum, columbium, hafnium, tantalum and tungsten exceeding 5%;

j. said composition being free from intentional additions of carbon, boron, zirconium and vanadium; balance essentially nickel;

which comprises:

adding cobalt in accordance with FIG. 1 wherein said alloy is stable for $N_v<2.82-((W+2Mo)\times0.058)$ for a 10% addition of cobalt and said alloy is stable for $N_v<2.74-((W+2Mo)\times0.057)$ for a 5% addition of cobalt.

11. A method of rendering an otherwise phase unstable rhenium containing nickel base superalloy phase stable, said alloy consisting essentially of:

a. from about 7% to about 12% chromium;

b. from about 2% to about 8% aluminum;

c. up to about 6% titanium, with the sum of the aluminum and titanium contents being at least 4% and the ratio of aluminum to titanium being at least 1:1;

d. from about 1.0% to about 9.5% tantalum;

e. from about 2% to about 12% tungsten;

f. up to about 3% molybdenum;

g. up to about 3% columbium;

h. up to about 3.5% hafnium;

i. an intentional addition of rhenium of up to 7%;

j. with the sum of molybdenum, columbium, hafnium, rhenium, tantalum and tungsten exceeding 5%;

k. said composition being free from intentional additions of carbon, boron, zirconium and vanadium; balance essentially nickel;

which comprises:

adding cobalt in accordance with FIG. 2 wherein said alloy is stable for $N_v<2.56-0.027\ (W+2Mo+2Re)$ for a 10% addition of cobalt and said alloy is stable for $N_v<2.23-0.027\ (W+2Mo+2Re)$ for a 5% addition of cobalt.

12. A composition useful in the production of single crystal turbine articles comprised of:

a. about 5% chromium;

b. from about 2% to about 8% aluminum;

c. up to about 6% titanium, with the sum of the aluminum and titanium contents being at least 4% and the ratio of aluminum to titanium being at least 1:1;

d. up to about 9.5% tantalum;

e. up to about 1% tungsten;

f. up to about 2.1% molybdenum;

g. up to about 3% columbium;

h. up to about 3.5% hafnium;

i. up to about 3% rhenium;

j. with the sum of molybdenum, columbium, hafnium, rhenium, tantalum and tungsten exceeding 5%;

k. said composition being free from intentional additions of carbon, boron, zirconium and vanadium;

l. between about 10% and about 15% cobalt; balance essentially nickel.

13. A composition as in claim 12 in which the sum of the Ta+W+Mo+Cb+Hf+Re exceeds about 10%.

* * * * *